US008922132B2

(12) United States Patent
Fortini et al.

(10) Patent No.: US 8,922,132 B2
(45) Date of Patent: Dec. 30, 2014

(54) LOAD SYSTEM HAVING A CONTROL ELEMENT POWERED BY A CONTROL SIGNAL

(75) Inventors: Alessandro Fortini, Pistoia (IT); Pierre Deschenes, Muskego, WI (US); Andrew Dan Bendtsen, Milwaukee, WI (US)

(73) Assignee: Cree, Inc., Durham, NC (US)

( * ) Notice: Subject to any disclaimer, the term of this patent is extended or adjusted under 35 U.S.C. 154(b) by 128 days.

(21) Appl. No.: 13/589,692

(22) Filed: Aug. 20, 2012

(65) Prior Publication Data

US 2014/0049186 A1 Feb. 20, 2014

(51) Int. Cl.
*H05B 37/02* (2006.01)
*H05B 37/00* (2006.01)

(52) U.S. Cl.
USPC ..... 315/250; 315/192

(58) Field of Classification Search
CPC ..... H05B 37/02; H05B 37/0524; H05B 37/00
USPC ..... 315/250, 192, 291, 210, 217, 307, 312
See application file for complete search history.

(56) References Cited

U.S. PATENT DOCUMENTS

| | | | | |
|---|---|---|---|---|
| 6,683,419 | B2 | 1/2004 | Kriparos | |
| 7,038,399 | B2 | 5/2006 | Lys et al. | |
| 7,352,138 | B2 | 4/2008 | Lys et al. | |
| 8,217,591 | B2 | 7/2012 | Chobot et al. | |
| 2010/0327765 | A1* | 12/2010 | Melanson et al. | 315/291 |
| 2011/0057576 | A1 | 3/2011 | Otake et al. | |
| 2011/0227502 | A1 | 9/2011 | Kim et al. | |
| 2011/0279032 | A1 | 11/2011 | Cartwright | |
| 2011/0285323 | A1 | 11/2011 | Kuo et al. | |
| 2012/0062128 | A1 | 3/2012 | Spillman et al. | |
| 2012/0062138 | A1 | 3/2012 | Wilson et al. | |
| 2012/0104968 | A1* | 5/2012 | Shiu et al. | 315/291 |
| 2012/0112650 | A1* | 5/2012 | Kuo et al. | 315/200 R |
| 2012/0153866 | A1* | 6/2012 | Liu | 315/294 |
| 2012/0286686 | A1 | 11/2012 | Watanabe et al. | |

* cited by examiner

*Primary Examiner* — Daniel D Chang
(74) *Attorney, Agent, or Firm* — McCracken & Gillen LLC

(57) ABSTRACT

A driver is connectable to an external power supply and configured to output variable electrical power for one or more loads, such as LEDs. A module including a microcontroller is operable to output a control signal that automatically varies the electrical power outputted by the driver. The microcontroller is further configured to be powered by the control signal.

8 Claims, 3 Drawing Sheets

LOAD SYSTEM HAVING A CONTROL ELEMENT POWERED BY A CONTROL SIGNAL

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to lamp modules, and more particularly to a electronic module for a lighting fixture powered by a dimming control.

2. Description of the Background of the Invention

Lamp drivers have been devised that provide power to one or more lamp loads, such as one or more LEDs arranged in one or more modules. The LEDs, particularly of late, develop a very bright light output but consume relatively little power compared to other types of lamps.

Some lamp drivers have been designed to provide variable power to LEDs to obtain a dimming effect. Such dimming drivers or dimming modules may provide variable power in response to a user input or according to a predetermined schedule that is implemented by a controller. The International Electrotechnical Commission (IEC) has published standard 60929, Annex E, entitled "Control Interface for Controllable Ballasts" (© IEC: 2006) that specifies operational parameters for controllable ballasts. The IEC standard specifies that as an input control signal varies between 1 and 10 volts, the arc power of the controllable ballast must similarly vary between minimum and maximum values. In known designs for driving one or more LEDs in a dimmable manner, the controller receives power from a power supply coupled to the AC mains (i.e., the residential or commercial power supplied by the electric utility) to power the circuit element(s) that develop the 1-10 volt dimming signal. The need for a power supply to convert the AC utility power to variable DC power for powering the controller increases production complexity and expenses and may involve complications in complying with industry standards.

SUMMARY OF THE INVENTION

According to one aspect of the present invention, a load system includes a controllable load, a driver coupled to the load for providing electrical power thereto in dependence upon a control signal, and a control element coupled to the driver that develops the control signal wherein the controller is powered by the control signal.

According to another aspect of the present invention, a lighting device comprises a light emitting diode (LED) and an LED driver coupled to the light emitting diode. The LED driver is configured to receive an electrical voltage from an AC external power source and provide variable power to the LED in accordance with a dimming signal. A lighting module includes a controller coupled to the LED driver wherein the lighting module develops the dimming signal and the controller is powered by the dimming signal.

According to yet anther aspect of the present invention, a lighting device includes a plurality of light emitting diodes (LEDs) and an LED driver coupled to the plurality of light emitting diodes, wherein the LED driver is configured to receive an electrical voltage from an AC external power source and provide variable DC power to the plurality of LEDs such that the LEDs develop an output intensity in accordance with a dimming signal. A lighting module includes a controller coupled to the LED driver wherein the lighting module develops the dimming signal and the controller is powered by the dimming signal.

BRIEF DESCRIPTION OF THE DRAWINGS

Further aspects of the present invention will become evident by a reading of the attached specification and inspection of the attached drawings in which.

DETAILED DESCRIPTION OF THE PREFERRED EMBODIMENTS

The present invention is related to a load system that may comprise, for example, a lighting apparatus. In one embodiment, the lighting apparatus uses at least one, and preferably a plurality of light emitting diodes (LEDs) to emit light. The emitted light may be of different intensities or other variable visual characteristic(s), such as emitted light color in a "true color" system, depending upon the desires of a user or operator. A user or operator may adjust a manual control switch associated with the lighting apparatus to vary the intensity of the emitted LED light. Alternatively or in addition, the lighting apparatus may include a programmable or switchable device, such as a microcontroller, an ASIC, a processor, etc. that can be switched or programmed to vary the intensity and/or other visual or other operational characteristic of the emitted LED light automatically according to a predetermined function or algorithm. Thus, for example, the intensity may be controlled as a function of time of day. Alternatively or additionally, a user may operate the programmable or switchable device at any given time to vary the intensity of the emitted LED light according to the user's desires at that time. The device also could be set to stabilize the output current at a given level lower than the maximum without any other variations during the operating of the fixtures.

The lighting apparatus includes a driver and a lighting module that are in electrical communication with the LEDs. The driver is configured to connect to an external power supply, such as 110 VAC or 230 VAC utility operational power. The driver regulates the electrical power to control the power applied to the LEDs so that dimming (and/or variation of one or more other operational characteristic(s)) is enabled in accordance with a signal developed by the lighting module and to ensure that the LEDs do not receive too much power such that they prematurely burn out.

Figure 1:
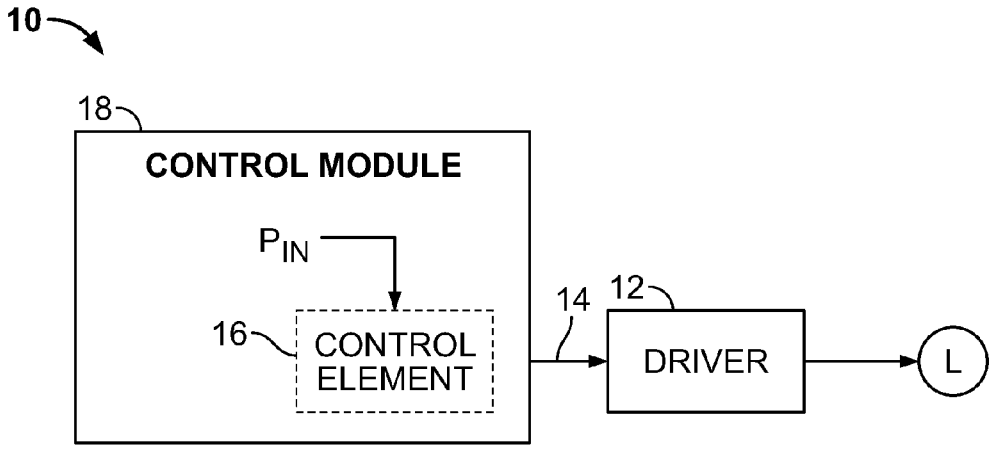
FIG. 1 is a block diagram of a load system in accordance with one aspect of the present invention.

Referring first to FIG. 1, according to a general aspect of the present invention, a load system 10 includes a load L operated by a driver 12 in accordance with a control signal developed on a line 14 by circuitry including a control element 16. In accordance with a preferred embodiment of the present invention, the control element 16 receives operating power $P_{IN}$ comprising the control signal on the line 14. The control element 16 is preferably a part of a control circuit or module 18 that may have other component(s) that receive the control signal as operational power. The output of the control element 16 may be conditioned before being delivered on the line 14. Also, the operating power for the control element 16 may be conditioned by circuitry, such as a power supply as noted in greater detail hereinafter in connection with FIG. 2, before being applied to the control element 16 such that the operating power voltage, for example, is maintained within specified limits for the element 16. Obtaining operating power for the control element 16 from the control signal may reduce the expense and complexity of the control module 18.

Figure 2:
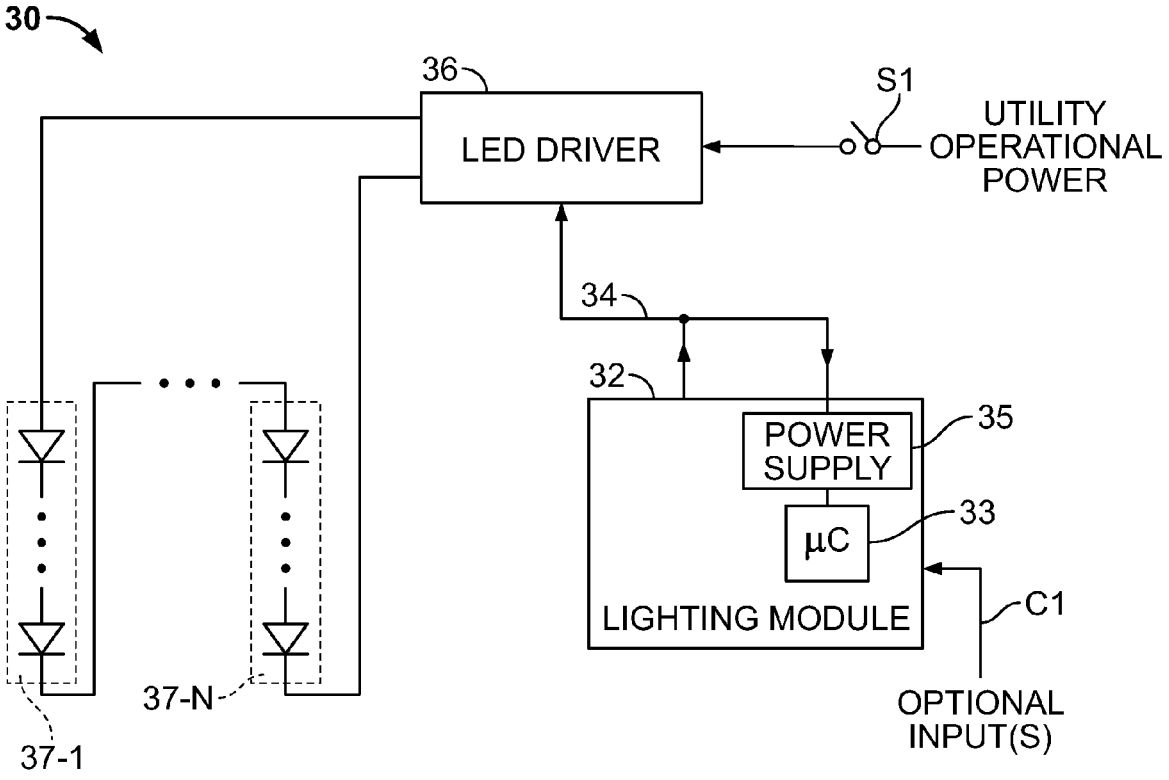
FIG. 2 is a combined schematic and block diagram of a lighting device in accordance with another aspect of the present invention.

Referring next to FIG. 2, a specific embodiment of the load system 10 comprises a lighting device 30 comprising a lighting fixture. In the illustrated embodiment, the control module comprises a lighting module 32 having a control element in the form of a microcontroller 33. The microcontroller may be replaced by one or more other different device(s), such as an ASIC, a processor, a switching device, or the like and any associated storage or memory. In any event, the lighting module 32 develops a control signal comprising a dimming signal over one or more lines or conductors 34 that are coupled to an LED driver 36. The LED driver 36 provides appropriately conditioned DC power (or, if desired, appropriate AC power) to one or more LEDs, which may be arranged in LED modules 37-1 through 37-N. The LED modules 37-1 through 37-N may be identical to one another and may be connected together in series. Each LED module, such as the module 37-1, may comprise two or more LEDs connected together in series. In some embodiments there may be between 10 and 240 LEDs that receive power from the driver 36. Also, in some embodiments, each LED module comprises a light bar (i.e., a series of LEDs arranged in a linear pattern) or the LED module comprises one or more LEDs arranged in a one or more array(s) of different shape or configuration. Further, the various components may be grouped or arranged together in different combinations than those illustrated in the FIGS. Thus, for example, each LED module may have an integral driver associated and packaged therewith, all of the various LED modules may be packaged together, fewer than all LED modules may be packaged together while remaining LED modules are separate, all of the various LED modules are separate from one another, etc.

Power is provided on the line(s) 34 by the driver 36 and the control signal is developed by the lighting module 32 on the line(s) 34 by modulating and/or providing the voltage appearing thereon. Specifically, in one embodiment, the driver 36 provides a current magnitude over the line(s) 34 to a controllable impedance in the lighting module 32. The current flowing through the controllable impedance causes a control signal voltage to appear on the line(s) 34. Preferably, the control signal, when active, is in a range between 1 and 10 volts, per International Electrotechnical Commission (IEC) standard. Alternatively, the control signal may use the undefined range of voltages specified by the International Electrotechnical Commission (IEC) published standard 60929, Annex E, entitled "Control Interface for Controllable Ballasts" (© IEC: 2006) to perform other functions such as but not limited to shutdown, addressing, feedback, etc. For example, a shutdown interface may be responsive to the control signal assuming a magnitude outside of a 0-10 volt dimming range to shut down the lighting device 30. Such a shutdown interface is disclosed in co-pending application Ser. No. 13/524,607, filed Jun. 15, 2012, entitled "Lamp Driver Having a Shutdown Interface Circuit," owned by the assignee of the present application and the disclosure of which is hereby incorporated by reference herein. Such application discloses that the controllable impedance in the lighting module 32 may create signals or respond to signals within the range of −20 volts to +20 volts. Additionally, the lighting module 32 may have the ability to release control of the line(s) 34 if it is determined by the controller that the signal is intended for any other purpose. Also preferably, the control element and other elements of the lighting module 32 are powered directly or indirectly by the control signal. Thus, in the illustrated embodiment, the microcontroller 33 receives operational power from a power supply 35 that, in turn, receives the control signal on the line(s) 34. As would be understood by one of skill in the art, the power supply 35 receives the control signal on the line 34 and provides the microcontroller 33 with its operational voltage at the appropriate voltage level. As such, the power supply 35 can include voltage storage circuitry and/or voltage regulation circuitry, such as circuitry including capacitor(s), to provide the desired operational voltage to the microcontroller 33. In the preferred embodiment, the control element is a low power device that can operate at 2 volts or less operational power or at another suitable power level dependent upon the particular microcontroller that is used. In some embodiments, the microcontroller can operate at different voltage levels, such as 5V or less, between 1V and 5V or 1V and 2V. It should be noted that the microcontroller 33 may include on-board memory and one or more other device(s), and may be made and sold by Texas Instruments or another manufacturer.

The microcontroller 33 may automatically vary the output control signal of the lighting module 32 according to a schedule or algorithm as noted above, thereby varying the intensity of the LEDs. In a preferred embodiment, the microcontroller 33 may regulate the control signal on the line(s) 34 to reduce the power consumption and intensity of the LEDs at predefined times, such as during night hours. Consequently, the LEDs may be automatically controlled to accommodate predicted or prearranged usage patterns.

If desired, the lighting module 32 may receive one or more optional manual and/or automated inputs over one or more conductors C1. The input(s) on the conductor(s) C1 may be signals commanding a particular change in the control signal developed on the line(s) 34, or signal(s) commanding that the control signal developed on the line 34 not exceed a first limit or not go below a second limit, or signal(s) commanding that the control signal be maintained at a fixed level, or to command that the control signal be maintained between upper and lower limits, etc. The signal(s) on the conductor(s) C1 may be developed by any suitable device(s), such as controllable switching elements either alone in combination with one or more passive elements, passive element(s) alone, integrated circuit(s) including programmable, software, and/or firmware-operated devices, or a combination of any such devices.

The driver 36 receives operational power via a switch S1 from utility power. The switch S1 could be a manually operable switch, a plug, a solenoid controlled set of contactors, a circuit breaker, or other device that permits turn off and turn on of the lighting fixture. The switch could be also a main switch in an electrical panel useful to open an entire line of fixtures. In some embodiments, the switch S1 can be controlled by an external control system that responds to other inputs, such as time of day, ambient conditions, etc. The opening and closing of the switch S1 can be sensed by the microcontroller 33. In particular, the switch S1 is a manual or automatic switch that connects and disconnects the AC lines to the driver 36 to activate/program the lighting module 32.

Based on a particular sequence/duration of connecting/disconnecting the AC lines, the 1-10 V line will reflect the turning off and on of the AC power (e.g., the 1-10V line 34 goes to 0V when the AC power is switched off). As such, through the 1-10 V line 34, the lighting module 32 can detect the sequence and be programmed and/or activated accordingly. Depending on the embodiment, additional inputs could be provided to the lighting module 32 (e.g., from the AC line (directly or indirectly through the driver 36 or other circuitry), from the driver circuitry itself, from dip switches, and/or through other circuitry or inputs) to provide other functionality or ease of use in programming.

In the illustrated embodiment, the switch S1 is operable by a contractor or other user to command programming of the microcontroller 33. Thus, for example, the user may manipulate the switch S1 according to a predefined sequence of open/closed states to cause the microcontroller 33 to enter a programming mode of operation (the microcontroller 33 may include firmware that provides this functionality). Thereafter, the switch S1 may be manipulated between open and closed states in a further predefined sequence to program, for example, one or more interval(s) before a particular time of day (which may be referred to as "virtual midnight") and one or more interval(s) after the particular time of day during which the customer wants to change the level of dimming. As noted in greater detail hereinafter, the dimming levels may be determined by one or more dip switch(es), or by software. In some embodiments, other operational modes are possible which can also control other lighting parameters.

For example, the switch S1 may be moved to the opened state for a predetermined time and then moved to the closed state for a further predetermined time and this sequence may be repeated one or more additional times to cause the microcontroller 33 to enter the programming mode. Thereafter, the switch S1 may be moved to the open state and then to the closed state one or more times in a particular sequence to cause the microcontroller 33 to be programmed to operate in a particular manner as noted in greater detail hereinafter such that light levels during dimming and non-dimming operational modes are synchronized with times of day. The programming mode may then be exited, thereby transitioning to an operating mode of operation, again by a particular sequence of manipulations of the switch S1 between the open and closed states.

It should be noted that the low power nature of the microcontroller 33 may limit the available functionality that can be implemented either by the microcontroller 33 itself or by the lighting module 32. However, current or future advancements in low power devices may enable certain functionality, such as transmitting the dimming signal wirelessly or over AC power lines to the driver 36, programming of the microcontroller 33 using a computer, or the like.

Figure 3:
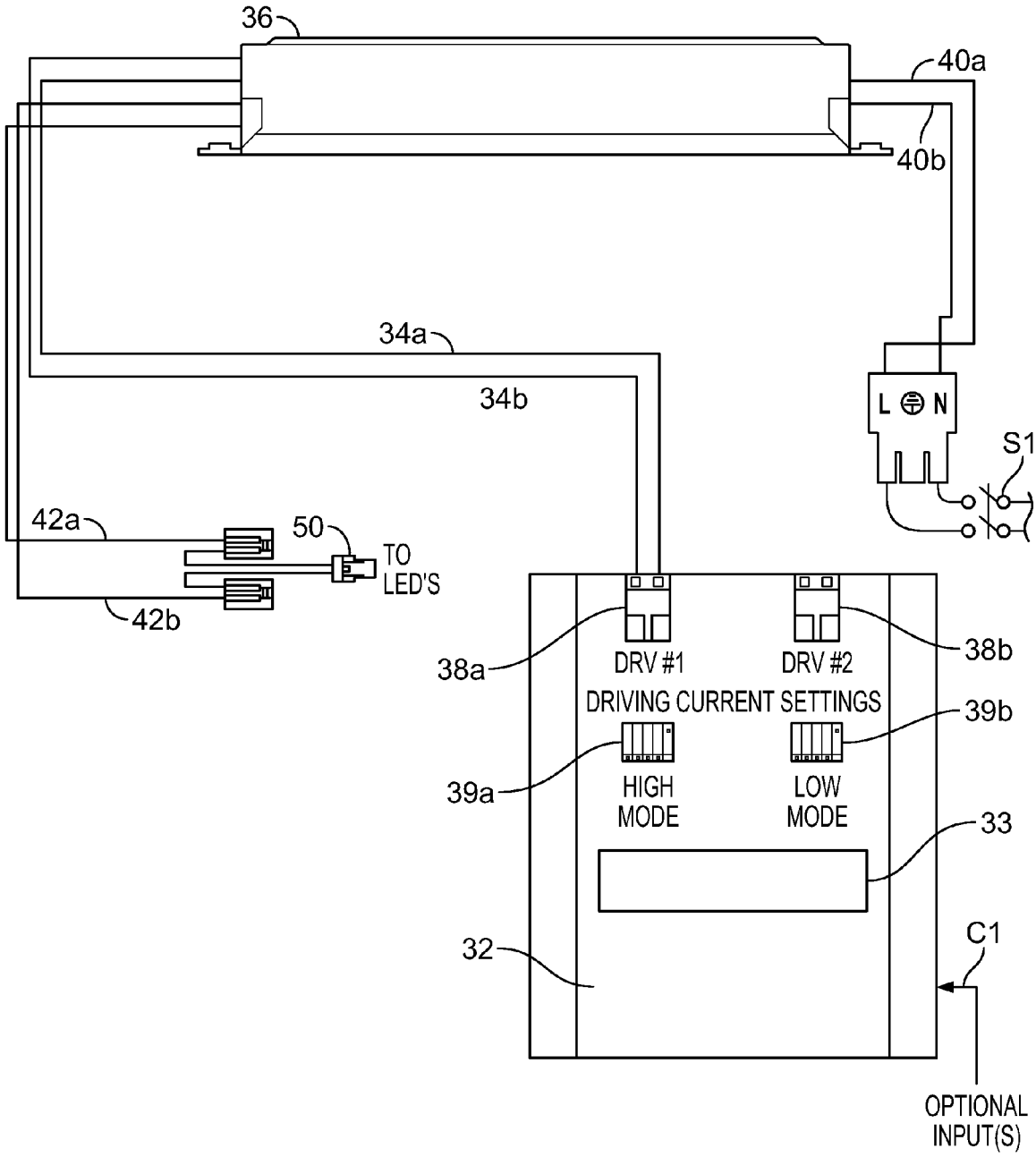
FIG. 3 is a wiring diagram of the lighting device of FIG. 2.

FIG. 3 illustrates a specific form of one embodiment of the present invention that utilizes a lighting module 32 that provides the dimming signal from one of two driver ports 38*a*, 38*b* over conductors 34*a*, 34*b* to the driver 36. The driver 36 receives utility power over conductors 40*a*, 40*b* through the switch S1 and the driver 36 develops conditioned power on conductors 42*a*, 42*b* that are coupled by a connector 50 to the LEDs.

The lighting module preferably includes two banks of manually settable switches 39*a*, 39*b* that permit a user or contractor to establish low and high levels for the dimming signal. The low level may be developed on the conductors 34*a*, 34*b* when a low light level is to be produced and the high level may developed on the conductors when a high light level is to be produced. This is useful to establish, for example, a low dimming level immediately before and after virtual midnight and a high dimming level during time periods before and after the low dimming level is in effect. However, one could utilize one or more elements, such as one or more dip switches with multiple positions, or passive or active elements, or a combination thereof, to adjust the output driver current to a given value and no more. More specifically, while the typical drive current of a lighting fixture may be 700 mA, one might wish to have lower drive currents, such as 350 mA, 525 mA, or 625 mA. Using the dip switches (or other element(s)) one could command the desired output current value.

Although the invention is not so limited, the microcontroller 33 and/or lighting module 32 may be adapted for use with existing fixtures that already use a Xitanium Dimmable Driver made and/or sold by Philips NV of the Netherlands as the driver 36. Of course, a different driver may be used. This may help reduce costs and simplify some designs. Additionally, the fact that the microcontroller 33 may be powered by the control signal on the line 34 may simplify assembly line work of the lighting module 32. This also serves to reduce the risk of non-conformity with certain CE Standards for Electrical Safety, such as EN 60598-1 or other standard(s) that deal with leakage current from high voltage sources.

Figure 4:
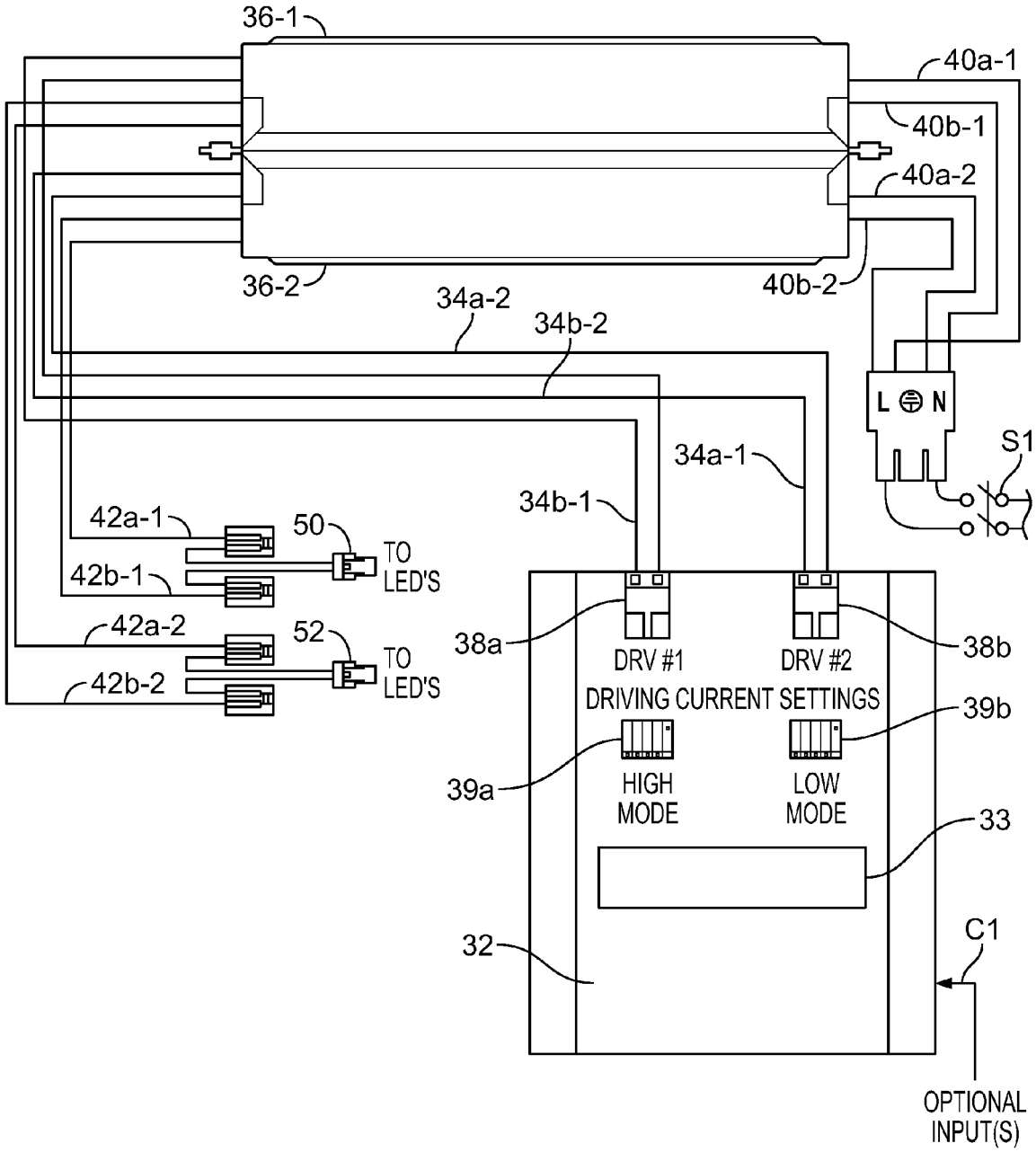
FIG. 4 is a wiring diagram of a further lighting device according to yet another aspect of the present invention.

FIG. 4 illustrates an embodiment that is identical to that shown in FIG. 3, except that the single driver 36 is replaced by a pair of drivers 36-1 and 36-2 that receive control signals from the driver ports 38*a*, 38*b*, respectively, over conductors 34*a*-1, 34*b*-1 and 34*a*-2, 34*b*-2, respectively. The driver 36-1 receives operational power over conductors 40*a*-1, 40*b*-1 and develops appropriately conditioned power on conductors 42*a*-1, 42*b*-1 that is delivered to a first set of LEDs by a connector 50. The driver 36-2 receives operational power over conductors 40*a*-2, 40*b*-2 and develops appropriately conditioned power for a second set of LEDs that is delivered over conductors 42*a*-2, 42*b*-2 and a connector 52. The embodiment of FIG. 4 operates identically to that shown in FIG. 3, except that two sets of LEDs that are coupled to the connectors 50, 52 are operated in accordance with first and second control signals developed on the conductors 34*a*-1, 34*b*-1 and 34*a*-2, 34*b*-2, respectively. The first and second control signals may be identical to one another or may be independent of one another, as desired. As in the previous embodiments, the microcontroller 33 and other components of the lighting module 32 are powered by one of the control signals or by a combination of the first and second control signals.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A load system, comprising:

a controllable load;

a driver coupled to the load for providing electrical power thereto in dependence upon a control signal;

a control circuit including a controller wherein the control circuit is coupled to the driver and develops the control signal wherein the controller is powered by the control signal; and an additional load and a further driver, the further driver coupled to the control circuit and the additional load, wherein the driver and the further driver provide electrical power to the load and the additional load respectively in dependence on the control signal that powers the controller.

2. The load system of claim 1, wherein the controllable load comprises a lamp and the control signal comprises a dimming signal.

3. The load system of claim 2, wherein the controller comprises a part of a dimming module.

4. The load system of claim 2, wherein the lamp comprises a light emitting diode (LED).

5. A lighting device, comprising:

a light emitting diode (LED);

an LED driver coupled to the light emitting diode, wherein the LED driver is configured to receive an electrical voltage from an AC external power source and provide variable DC power to the LED in accordance with a dimming signal;

a lighting module including a controller coupled to the LED driver wherein the lighting module develops the dimming signal and the controller is powered by the dimming signal; and an additional LED and an additional LED driver, the additional LED driver coupled to the controller and the additional LED, wherein the LED driver and the additional LED driver provide variable DC power to the LED and the additional LED respectively in accordance with the dimming signal that powers the controller.

6. The lighting device of claim 5, wherein the lighting module develops a 1-10 volt dimming signal.

7. A lighting device, comprising:

a plurality of light emitting diodes (LEDs);

an LED driver coupled to the plurality of light emitting diodes, wherein the LED driver is configured to receive an electrical voltage from an AC external power source and provide variable DC power to the plurality of LEDs such that the LEDs develop an output intensity in accordance with a dimming signal;

a lighting module including a controller coupled to the LED driver wherein the lighting module develops the dimming signal and the controller is powered by the dimming signal; and an additional plurality of LEDs and an additional LED driver, the additional LED driver coupled to the controller and the additional plurality of LEDs, wherein the LED driver and the additional driver provide variable DC power to the plurality of LEDs and the additional plurality of LEDs respectively in accordance with the dimming signal that powers the controller.

8. The lighting device of claim 7, wherein the lighting module develops a 1-10 volt dimming signal.

* * * * *